United States Patent [19]

Kropielnicki et al.

[11] 4,086,594

[45] Apr. 25, 1978

[54] ELECTRICAL SIGNAL SEPARATING DEVICE FOR COMBINED WINDSHIELD ANTENNA AND HEATER GRID

[75] Inventors: Barbara Ewa Kropielnicki; Jerzy Jacek Kropielnicki, both of Knutsford, England

[73] Assignee: B.S.H. Electronics (Manchester) Limited, Manchester, England

[21] Appl. No.: 722,625

[22] Filed: Sep. 13, 1976

[30] Foreign Application Priority Data

Nov. 21, 1975 United Kingdom ..... 47902/75

[51] Int. Cl.[2] ..... H01Q 1/02

[52] U.S. Cl. ..... 343/704; 343/713; 219/203

[58] Field of Search ..... 343/704, 713, 885; 219/203, 522

[56] References Cited

U.S. PATENT DOCUMENTS

| | | | |
|---|---|---|---|
| 2,102,410 | 12/1937 | Fyler | 343/885 |
| 3,866,232 | 2/1975 | Weigt | 343/713 |
| 3,928,748 | 12/1975 | Sauer | 343/704 |

FOREIGN PATENT DOCUMENTS

| | | | |
|---|---|---|---|
| 839,514 | 6/1952 | Germany | 343/704 |

*Primary Examiner*—Eli Lieberman

*Attorney, Agent, or Firm*—Shoemaker and Mattare, Ltd.

[57] ABSTRACT

A device which can be interposed between a radio and an electrically heated window so as to enable the to a d.c. power source to effect heating of same. The device comprises a blocking circuit having mutually coupled coils interposed between the d.c. power source and the terminals of the heating element of the window.

13 Claims, 4 Drawing Figures

ELECTRICAL SIGNAL SEPARATING DEVICE FOR COMBINED WINDSHIELD ANTENNA AND HEATER GRID

This invention relates to a device for separating a radio signal from the heating element of an electrically heated window whereby for example a heated rear window of a motor vehicle can be used simultaneously for heating purposes and as a radio aerial.

A device of this kind is disclosed in U.S. Pat. No. 3,484,584. With this known device large air-cored chokes are interposed between electrical connections of the heating element of a motor car heated rear window and the motor car d.c. power supply. The chokes provide a low resistance path for the d.c. power supply with the aim of avoiding interference with heating of the window, and they provide a high impedance path for radio signals picked up by the heating element with the aim of avoiding undue reduction in strength of signals picked up by the heated rear window and fed to the aerial circuit due to earthing of same through the car power supply.

With this known arrangement in order to ensure a sufficiently high impedance to radio signals at the usual broadcast frequencies whilst at the same time presenting a sufficiently low d.c. resistance to avoid excessive voltage drop at the usual high current rating of the heater element, it is necessary to use chokes which are physically of large dimensions. Problems can therefore arise with regard to manufacturing costs, convenient installation in a motor car, screening of the coils to avoid interference, and loss of signal strength due to coil capacitance. In addition, with the known arrangement the radio aerial circuit can pick up interference from the car ignition and other electrical circuits via the power supply.

An object of the present invention is to provide a separating device which can afford an effective means of separating radio signals from the heating element of an electrically heated window and yet which is simple and inexpensive to manufacture and convenient to install in a motor vehicle.

According to the invention therefore, an electrical signal separating device for separating a radio signal from the heating element of an electrically heated window comprises input terminals for connection to a motor vehicle d.c. power supply, power output terminals for connection to the heating element, a radio signal output terminal for connection to the aerial circuit of a radio receiver for feeding radio signals picked up by the heating element to the receiver, and a blocking circuit for blocking passage of said radio signals to the power supply, the blocking circuit comprising coils interposed respectively between the said input and power output terminals and being mutually coupled and arranged so as to provide high impedance paths for in-phase fluctuating currents at said power output terminals but low resistance paths for currents flowing through said circuit from the d.c. power supply.

With this arrangement due to the use of coupled coils it is possible to achieve effective signal separation with a device which is simple and inexpensive to manufacture and which can be of a small size conducive to the convenient installation of same in a motor vehicle.

Preferably, said coils are together formed by a bifilar winding, that is, they constitute substantially identical inductors wound in a common direction formed by winding together two separate wires for example on a common core such as a pot core.

With the coupled coils of the invention it is also possible to achieve removal of noise, or other electrical fluctuations likely to cause interference with the separated signal, from the power supply circuit whereby good reception quality and sensitivity can be attained. If desired, however, to further improve interference elimination, the device of the invention may also incorporate an interference suppressing choke, which may have an air gapped winding, and possibly also a filter capacitor.

It is visualised that the device of the invention will have particular application in the context of motor cars having heated rear windows, the device being mounted at an appropriate position close to the rear window and being connected to the heating element of the heated rear window, to the car d.c. power supply, and to the aerial circuit of a radio in the car.

With regard to the nature of the heated window this may take any suitable form and thus for example may comprise an electrical resistance heating element applied to the surface of the window or alternatively and preferably an electrical resistance heating element which is incorporated in the glass of the window or sandwiched between sheets thereof during the manufacture of the window.

The invention will now be described further by way of example only and with reference to the accompanying drawings in which.

Figure 1:
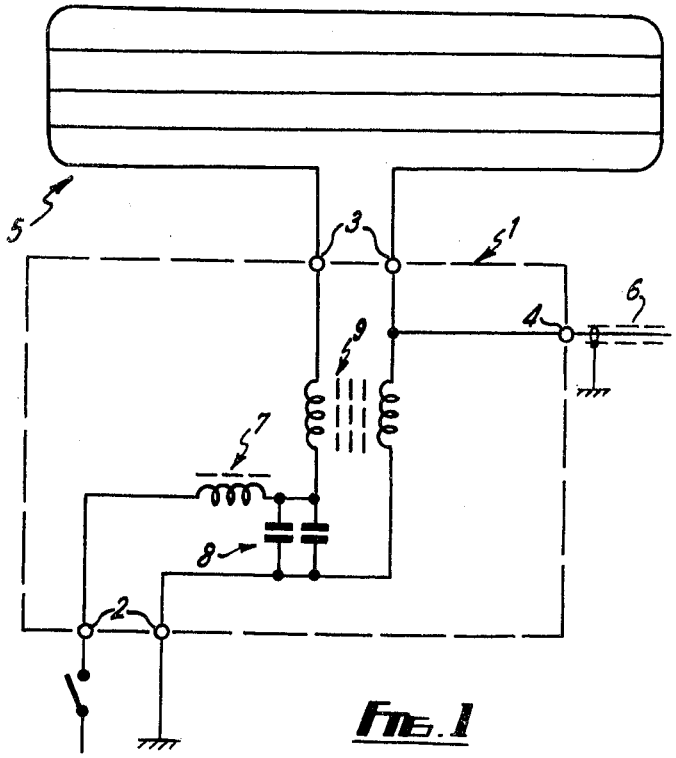
FIG. 1 is a circuit diagram of one form of device according to the present invention.

The device is for use in a motor vehicle to enable the heating element of a heated rear window of the vehicle to be used simultaneously as a radio aerial.

The device comprises, in an earthed case 1, a pair of input terminals 2, a pair of power output terminals 3, and a radio signal output terminal 4.

In use, the input terminals 2 are connected to the vehicle earth and the vehicle d.c. power supply via the usual control switch for the heating element, the output terminals 3 are connected to the heating element 5, and the output terminal 4 is connected to a shielded aerial cable 6 connected to the radio of the vehicle.

Within the case 1, the input terminals 2 are connected to the first output terminals 3 via a suppressor arrangement, made up of a choke 7 and two filter capacitors 8, and two coils 9 interposed one before each output terminal 3.

The choke 7 is of the pot core type and has 20 turns of 18 swg wire on a pot core of 36mm diameter and 23mm high. The winding of the choke 7 is air gapped to give an optimum inductance (say 60 to 100 $\mu$H) at a current of 10 amps this being a usual current rating of a motor car heated rear window. The filter capacitors 8 may comprise 1 $\mu$F ceramic capacitor for efficient high frequency filtering and 10 to 25 $\mu$F tantalum electrolytic for general decoupling.

The coils 9 are provided by a bifilar winding of 18 turns of 19 swg wire on a pot core of 30mm diameter and 19mm high, with no air gaps, giving an inductance of the order of 2mH.

If it is found to be necessary, the output terminals 3 may be interconnected by a capacitor (not shown) for equalisation purposes. In practice, however, equalisation is found to present no problems due to the fact, it is believed, that the heating element may act as a conductive sheet to radio signals rather than a conductive loop. Also if desired a decoupling capacitor (also not shown) may be arranged between the output terminal 4 and one side of the heating element 5.

In use, current can flow from the power supply through the heating element 5 and the coils 9 provide low impedance paths to such current. At the same time, radio signals picked up by the heating element 5 and which are in phase at the first output terminals 3, flow via the decoupling capacitor to the second output terminal 4 and from there to the radio. The coils 9 provide high impedance paths for the radio signals and thus the power supply circuit has little effect with regard to reduction of signal strength.

The coils 9, and the suppressor circuit, also act to prevent background noise, and other interfering fluctuations, from reaching the output terminal 4.

With the embodiment described it is therefore possible to obtain good quality and sensitivity of radio reception.

It will be appreciated that the device can be provided in a motor vehicle as original equipment or may be installed subsequently, simply by interposition in the lead to the heating element. In either case, in order to minimise inductive pick-up of interference signals, the device should preferably be arranged as near as possible to the heater 5.

It is of course to be understood that the invention is not intended to be restricted to the details of the above embodiment which are described by way of example only.

Figure 2:
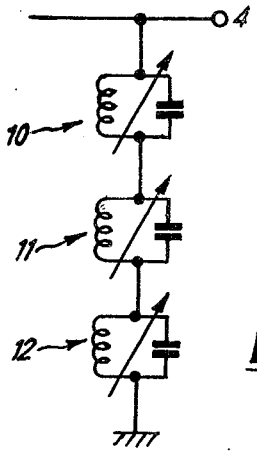
FIGS. 2 and 3 are circuit diagrams showing two modifications to the device.

Thus, for example, in a modification of the above embodiment and as shown in FIG. 2, a number of tuned inductance/capacitance circuits 10, 11, 12 may be connected in series with each other between the output terminal 4 and earth, each circuit being tuned to a frequency in the middle of a different broadcast band. Thus there may be FM, AM middle wave and AM long wave circuits. On each band the respective circuit presents a high impedance corresponding to a desired aerial loading and the other circuits present low impedance.

Since the inductance/capacitance circuits are not connected in the power supply circuit it will be appreciated that heavy duty components are not required. Further, the series arrangement of same obviates switching arrangements to accommodate band changes.

With the above described embodiment and the modification thereof it will of course be appreciated that values of components would be selected in accordance with required current carrying capacity and radio frequency range. Also the various components may be constructed and arranged otherwise than as specifically described. Thus for example the coils 9 and/or the coil 7 may involve torroidal windings and/or ferrite cores with a view to increasing inductance and/or reducing coil size if this is believed to be advantageous in relation to the cost of manufacturing same.

Figure 3:
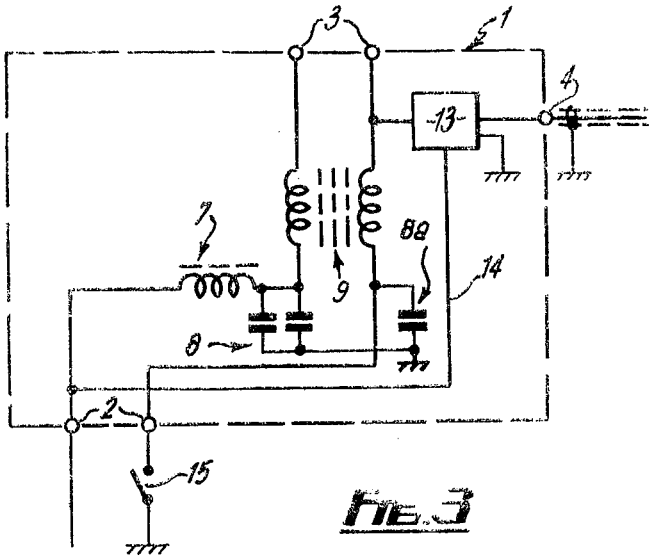

FIG. 3 shows a further modification of the device in accordance with which a broad band high gain solid state preamplifier 13 is interposed before the terminal 4. The preamplifier 13 may be powered by connecting same via a power input lead 14 to the 'live' terminal of the car power supply. Alternatively, and as shown, the lead 14 may be connected to the live terminal 2 and the switch 15 for controlling operation of the heated rear window may be connected in the earth side of the connection to the terminals 2. In this latter case, as shown in the drawing the decoupling capacitors 8 are preferably connected to local earth and the earth terminal 2 is decoupled via a capacitor 8*a*.

Figure 4:
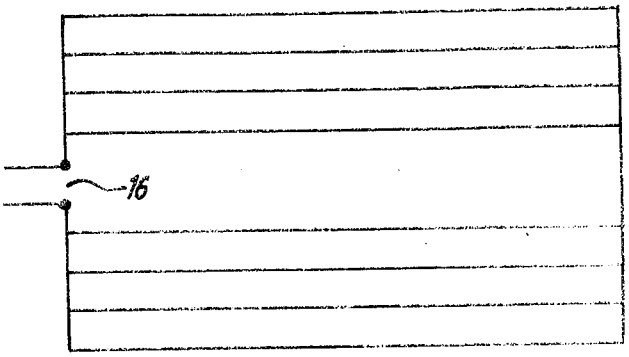
FIG. 4 is a circuit diagram showing a modified form of heated rear window for use with the device.

FIG. 4 shows a modified arrangement of a heated rear window which has the connections 16 close to each other at one side. With this arrangement, the casing 1 can be positioned close to the connections 16 so that two short leads of the same length can be used to connect the connections 16 to the terminals 3 thereby minimising interference pick-up. With the above described embodiment and the modification thereof it will be appreciated that the coupling of the similarly wound coils 9 gives rise to efficient signal separation due to inductive interaction of the in-phase radio signals in the two coils; and such coupling also gives rise to cancellation of the equal but opposite magnetic fluxes generated in the coils when current from the power supply flows in opposite directions through the two coils whereby core saturation due to such current can be avoided.

What we claim is:

1. An electrical signal separating device for separating a radio signal from the resistance heating element of an electrically heated window, comprising: an electrical circuit having input terminals for connection to a motor vehicle d.c. power supply, power output terminals for connection to the heating elements, and a radio signal output terminal for connection to the aerial circuit of a radio receiver for feeding radio signals picked up by the heating element to the receiver; said circuit further including a blocking circuit for blocking passage of said radio signals to the power supply, wherein the blocking circuit comprises a bifilar coil formed by two wires wound on a common core and defining two concentric coils, the coils being interposed respectively between the said input terminals and power output terminals and being mutually coupled and arranged so as to provide high impedance paths for in-phase fluctuating currents at said power output terminals but low resistance paths for currents flowing through said circuit from the d.c. power supply, said resistance heating element acting as a conductive sheet to radio signals, whereby the bifilar coil effectively blocks the radio frequency signals, while passing the current from the d.c. power supply to the heating element.

2. A device according to claim 1 wherein the bifilar winding is formed on a core free of air gaps.

3. A device according to claim 1 wherein an interference suppressing choke is interposed between one input terminal and the associated power output terminal.

4. A device according to claim 3 wherein the interference suppressing choke has an air-gapped winding.

5. A device according to claim 3 wherein a filter capacitor is connected between the input terminals after the interference suppressing choke.

6. A device according to claim 1 wherein an aerial tuning circuit is connected to the radio signal output terminal.

7. A device according to claim 6 wherein the tuning circuit comprises at least one tuned inductance/capacitance circuit connected between the radio signal output terminal and an earth connection so as to provide an aerial loading of impedance appropriate to one or more broadcast bands.

8. A device according to claim 1 wherein a preamplifier is connected before the radio signal output terminal.

9. An electrical signal separating device for separating a radio signal from the resistance heating element of an electrically heated window comprising: an earthed case enclosing an electrical circuit having a pair of input terminals for connection to a source of d.c. power, a pair of power output terminals for connection to the resistance heating element, and a radio signal output terminal for connection to a radio receiver; said circuit including a radio signal blocking circuit comprising a bifilar coil formed by a simple winding of two wires defining a pair of concentric coils interposed respectively between the input terminals and the power output terminals, said radio signal output terminal connected between the bifilar coil and the power output terminals, and said heating element acting as a sheet conductor applying in-phase radio signals to the power output terminals, whereby the bifilar coil effectively blocks the radio signals from the power input terminals while passing the current from the power input terminals to the power output terminals.

10. A device as in claim 9 wherein the windings of the bifilar coil are wound on a pot core free of air gaps.

11. A device as in claim 10 wherein the electrical circuit further includes an interference suppressing choke interposed between one input terminal and the associated winding of the bifilar coil.

12. A device as in claim 11 wherein a filter capacitor is connected between the input terminals after the interference suppressing choke.

13. A device as in claim 9 wherein an aerial tuning circuit is connected to the radio signal output terminal, said turning circuit comprising at least one tuned inductance/capacitance circuit connected between the radio signal output terminal and an earth connection so as to provide an aerial loading of impedance appropriate to one or more broadcast bands.

* * * * *

UNITED STATES PATENT AND TRADEMARK OFFICE

Certificate

Patent No. 4,086,594 Patented April 25, 1978

Barbara Ewa Kropielnicki and Jerzy Jacek Kropielnicki

Application having been made by Barbara Ewa Kropielnicki and Jerzy Jacek Kropielnicki, the inventors named in the patent above identified, and B.S.W. Electronics (Manchester) Limited, Manchester M2 2Ld. a Scottish Company, the assignee, for the issuance of a certificate under the provisions of Title 35, Section 256, of the United States Code, deleting the name of Barbara Ewa Kropielnicki as a joint inventor, and a showing and proof of facts satisfying the requirements of the said section having been submitted, it is this 17th day of March 1981, certified that the name of the said Barbara Ewa Kropielnicki is hereby deleted from the said patent as a joint inventor with the said Jerzy Jacek Kropielnicki.

FRED W. SHERLING,

*Associate Solicitor.*